US006003592A

United States Patent [19]

Yamamoto et al.

[11] Patent Number: 6,003,592

[45] **Date of Patent: *Dec. 21, 1999**

[54] REFRIGERANT CONDENSER

[75] Inventors: Michiyasu Yamamoto, Chiryu; Ken Yamamoto, Obu; Ryouichi Sanada, Kariya, all of Japan

[73] Assignee: Denso Corporation, Kariya, Japan

[ * ] Notice: Under 35 U.S.C. 154(b), the term of this patent shall be extended for 917 days.

[21] Appl. No.: 08/571,032

[22] Filed: Dec. 12, 1995

Related U.S. Application Data

[63] Continuation of application No. 08/155,227, Nov. 22, 1993, abandoned.

[30] Foreign Application Priority Data

Nov. 25, 1992 [JP] Japan ..... 4-314932
Sep. 17, 1993 [JP] Japan ..... 5-231653

[51] Int. Cl.[6] ..... F28F 13/06

[52] U.S. Cl. ..... 165/110; 165/146; 165/DIG. 222

[58] Field of Search ..... 165/110, 146, 165/174

[56] References Cited

U.S. PATENT DOCUMENTS

| | | | |
|---|---|---|---|
| 4,141,409 | 2/1979 | Woodhull, Jr. et al. | 165/110 |
| 4,998,580 | 3/1991 | Guntly et al. | 165/133 |
| 5,190,100 | 3/1993 | Hoshino et al. | 165/146 |

FOREIGN PATENT DOCUMENTS

| | | |
|---|---|---|
| 3-45300 | 7/1991 | Japan . |
| 3-45301 | 7/1991 | Japan . |

*Primary Examiner*—Allen Flanigan
*Attorney, Agent, or Firm*—Pillsbury Madison & Sutro LLP

[57] ABSTRACT

A refrigerant condenser set so that a condensation distance L (mm) of the condenser falls between 400+1180 de and 700+1180 de where de (mm) is the equivalent diameter of the tubes forming the core. By setting the condensation distance L in this way, the heat exchange rate becomes higher and it is possible to determine the number of turns required for the distance L.

2 Claims, 8 Drawing Sheets

REFRIGERANT CONDENSER

This is a continuation of application Ser. No. 08/155,227, filed on Nov. 22, 1993, which was abandoned upon the filing hereof.

BACKGROUND OF THE INVENTION

1. Field of the Invention

The present invention relates to a refrigerant condenser comprised of a pair of headers connected by a plurality of tubes, through which tubes a refrigerant flows in a serpentine manner.

2. Description of the Related Art

In the past, as this type of refrigerant condenser, provision has been made of a multiflow (MF) type refrigerant condenser such as the one shown in FIG. 8. That is, a pair of headers 1 and 2 are connected by a plurality of tubes 3 comprised of flat tubes. In the headers 1 and 2 are arranged separators at predetermined positions so that the refrigerant will flow in a serpentine manner through the tubes 3 between the headers 1 and 2.

In this case, to raise the heat exchange rate, Japanese Unexamined Patent Publication (Kokai) No. 63-161393 discloses a construction in which the number of times the refrigerant changes direction of flow in the headers 1 and 2 (hereinafter referred to as number of "turns") is set to one or more, while Japanese Unexamined Patent Publication (Kokai) No. 63-34466 discloses a construction in which the number of tubes making up the refrigerant passageway is reduced so as to reduce the cross-sectional area of the refrigerant passage from the inlet to the outlet.

In a refrigerant condenser comprised of a refrigerant passage which is turned back and forth as in the above-mentioned related art, however, if the number of turns of the refrigerant passage is increased to set the condensation distance large, while it is possible to increase the flow rate of the refrigerant and raise the heat exchange rate, the pressure loss inside the tubes increases, whereby the refrigerant pressure falls and along with this the problem arises of a fall in the condensation temperature. Therefore, when the number of turns of the refrigerant passage is set excessively large, the temperature difference between the outside air and the refrigerant becomes smaller, which is a factor behind a reduced heat exchange performance.

On the other hand, if the number of turns of the refrigerant passage is reduced to set the condensation distance smaller, while it is possible to decrease the pressure loss in the tubes, the flow rate of the refrigerant ends up falling, the heat exchange rate in the tubes becomes smaller, and the performance falls, which creates another problem. In view of the above, there assumingly is a number of turns of the refrigerant passage which is optimal for each heat exchanger.

The above-mentioned related art, however, merely suggest that increasing the number of turns or decreasing the sectional area of the passage contributes to an improved heat exchange rate. They do not go so far as to specify the optimal condensation distance for a heat exchanger and therefore do not solve the basic problem of improving the heat exchange rate.

SUMMARY OF THE INVENTION

The present invention was made in consideration of the above circumstances and has as its object the provision of a refrigerant condenser which enables the heat exchange rate to be designed to a high value by specifying the optimal condensation distance in a condenser constructed with the refrigerant passage turned back and forth.

The present invention achieves the above object by the provision of a refrigerant condenser which is provided with:

a plurality of superposed tubes, a pair of headers joined to the tubes at the two ends, and separators disposed inside the headers for dividing the tubes into a plurality of groups, a high temperature, high pressure gaseous refrigerant flowing through the tube groups changing in direction of flow in the headers, when the number of times the direction of flow is changed in the headers being N (integer) and the distance between the pair of headers being W (unit: mm), the condensation distance L (unit: mm) of the refrigerant being expressed by $L=(N+1)W$, the condensation distance L (unit: mm) being $L=400+1180\,de$ to $700+1180\,de$ when the equivalent diameter in the tubes corresponding to the tube area is de (unit: mm) and $de<1.15$.

When the condensation distance L of the refrigerant condenser is set to a value calculated by the above-mentioned equation, the heat exchange rate of the refrigerant condenser becomes optimal, so by setting the number of turns of the refrigerant passage so that the above equation is satisfied, it is possible to obtain a refrigerant condenser with an optimal heat exchange rate.

BRIEF DESCRIPTION OF THE DRAWINGS

Other objects and effects of the present invention will become clearer from the following detailed description of embodiments made with reference to the drawings, in which.

DESCRIPTION OF THE PREFERRED EMBODIMENTS

Figure 1:
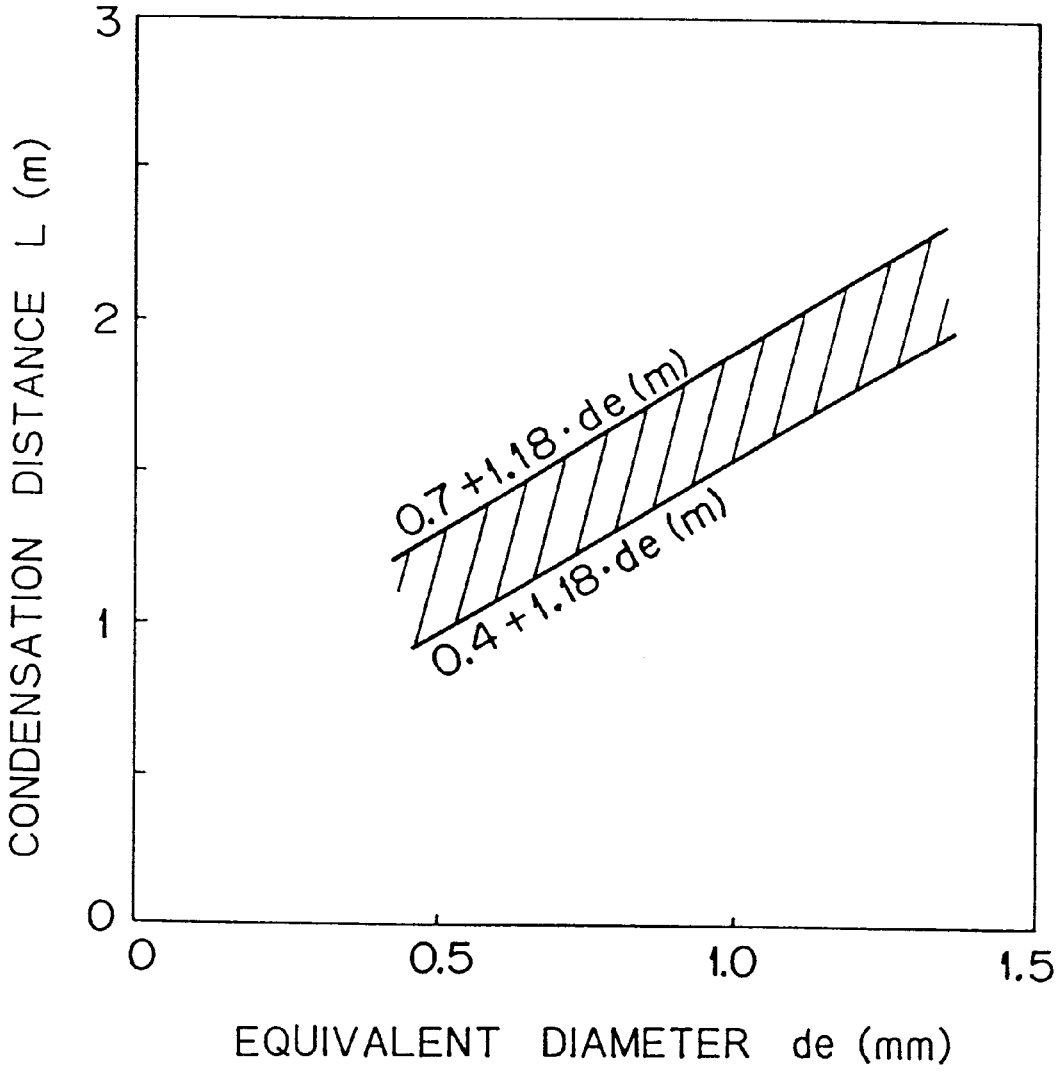
FIG. 1 is a view of the relationship between the equivalent diameter of the tubes and the condensation distance in an embodiment of the present invention.
Figure 2:
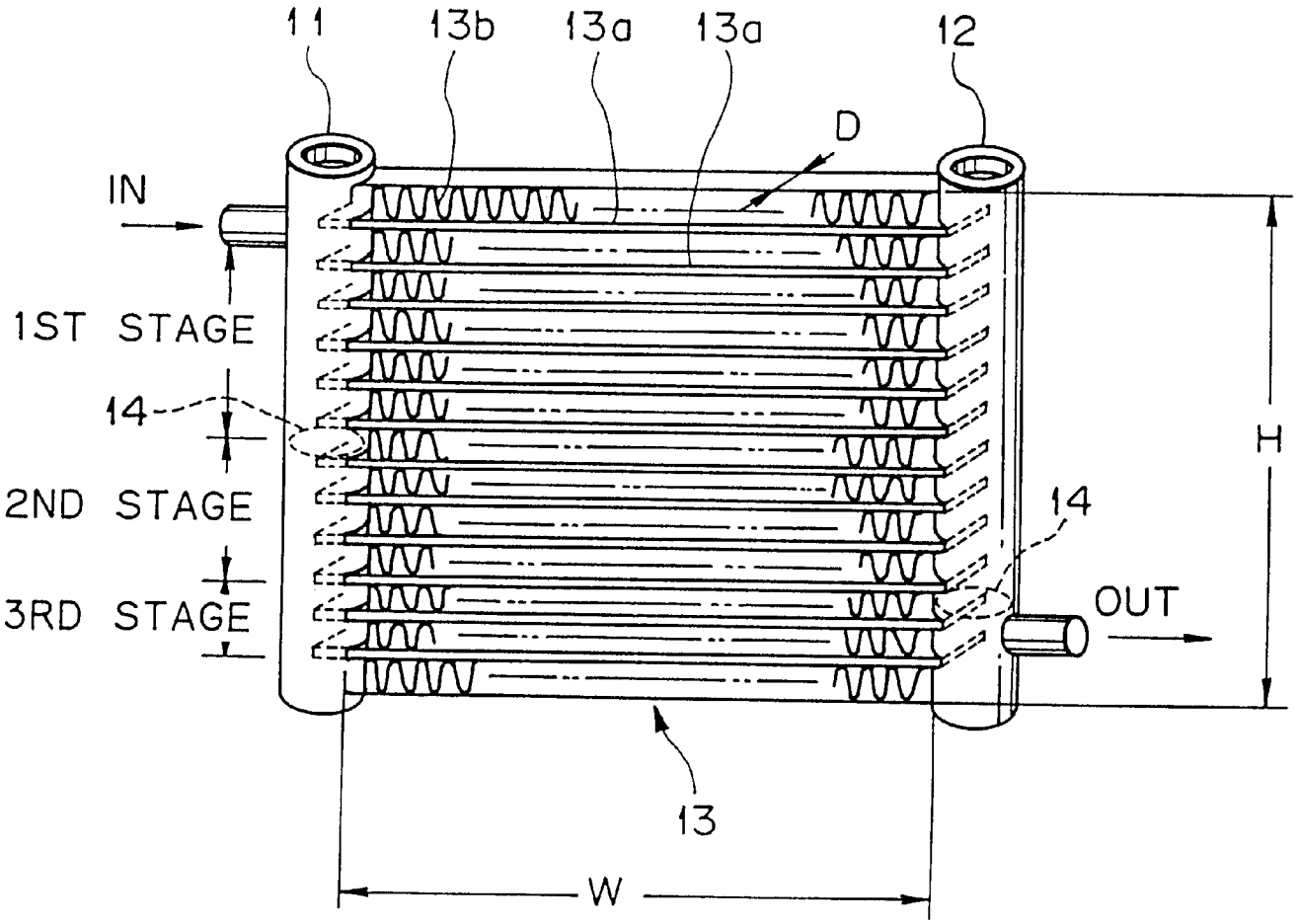
FIG. 2 is a schematic view of the construction of a heat exchanger.
Figure 3:
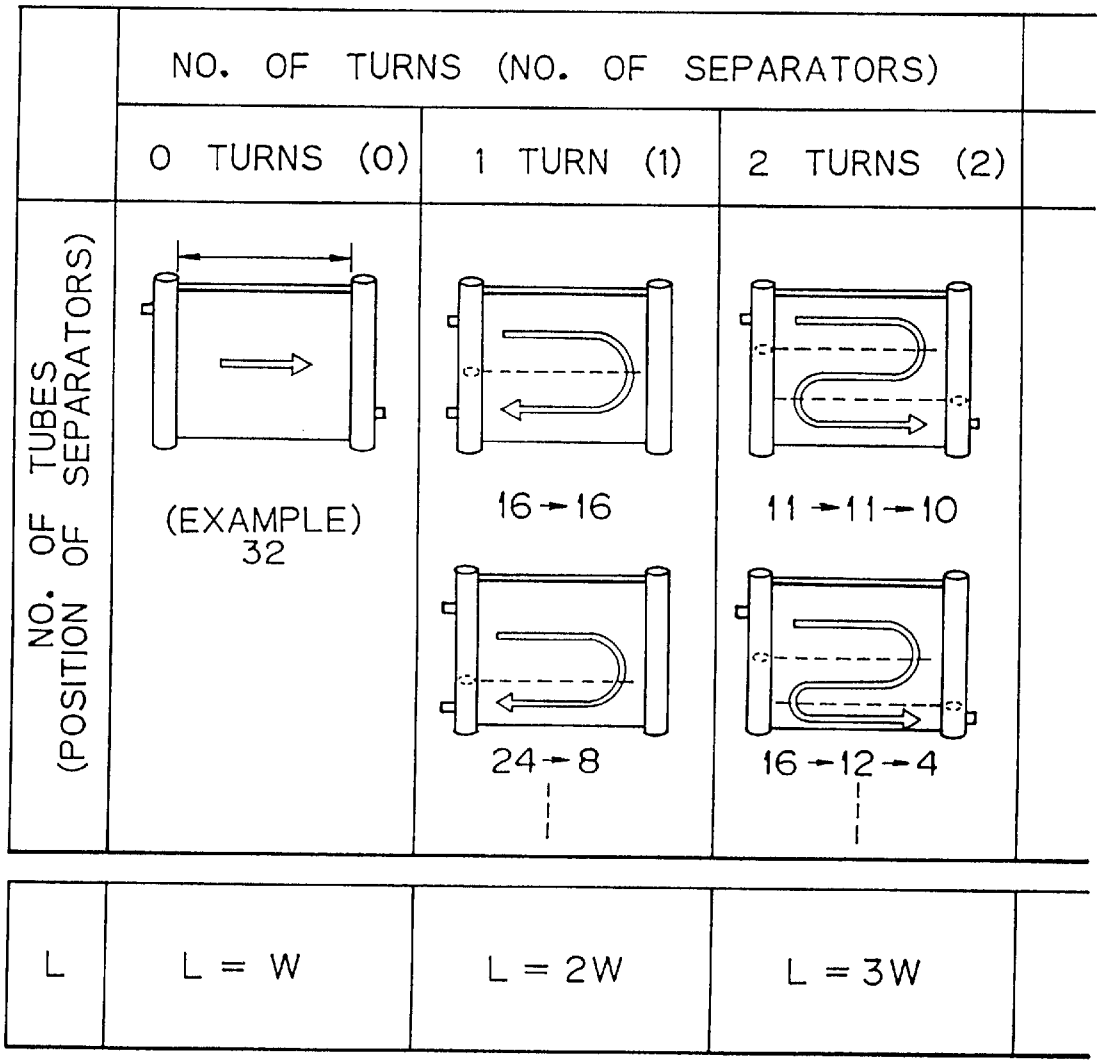
FIG. 3 is a view of the relationship between the number of turns of the refrigerant passage, the combination of the tubes, and the condensation distance.

Below, an embodiment of the present invention applied to a refrigerant condenser of a car air-conditioner is described with reference to FIG. 1 to FIG. 7. FIG. 2 shows an MF type refrigerant condenser. In FIG. 2, a pair of headers 11 and 12 are connected by a core 13. The core 13 is comprised of a plurality of tubes 13*a* comprised of flat tubes between which are welded corrugated fins 13*b*. Separators 14 are disposed at predetermined positions in the headers 11 and 12. It is possible to set the number of turns of the refrigerant passage to any number as shown in FIG. 3 by the position of disposition of the separators 14. That is, when there are 32 tubes 13*a*, with 0 turns, all the 32 tubes 13*a* form a refrigerant passage oriented in one direction. In this case, the condensation distance L becomes W. Here, W is the distance between the headers 11 and 12 and matches with the lateral width of the core 13. With 1 turn, it is possible to set the tubes 13*a* to a combination of 16 and 16, a combination of 24 and 8, etc. In this case, the condensation distance L becomes 2W. Further, with 2 turns, it is possible to set the tubes 13*a* to a combination of 11, 11, and 10, a combination of 16, 12, and 4, etc. In this case, the condensation distance L becomes 3W. FIG. 3 shows an example of a combination of the tubes 13*a*, but is possible to set any combination.

Figure 4:
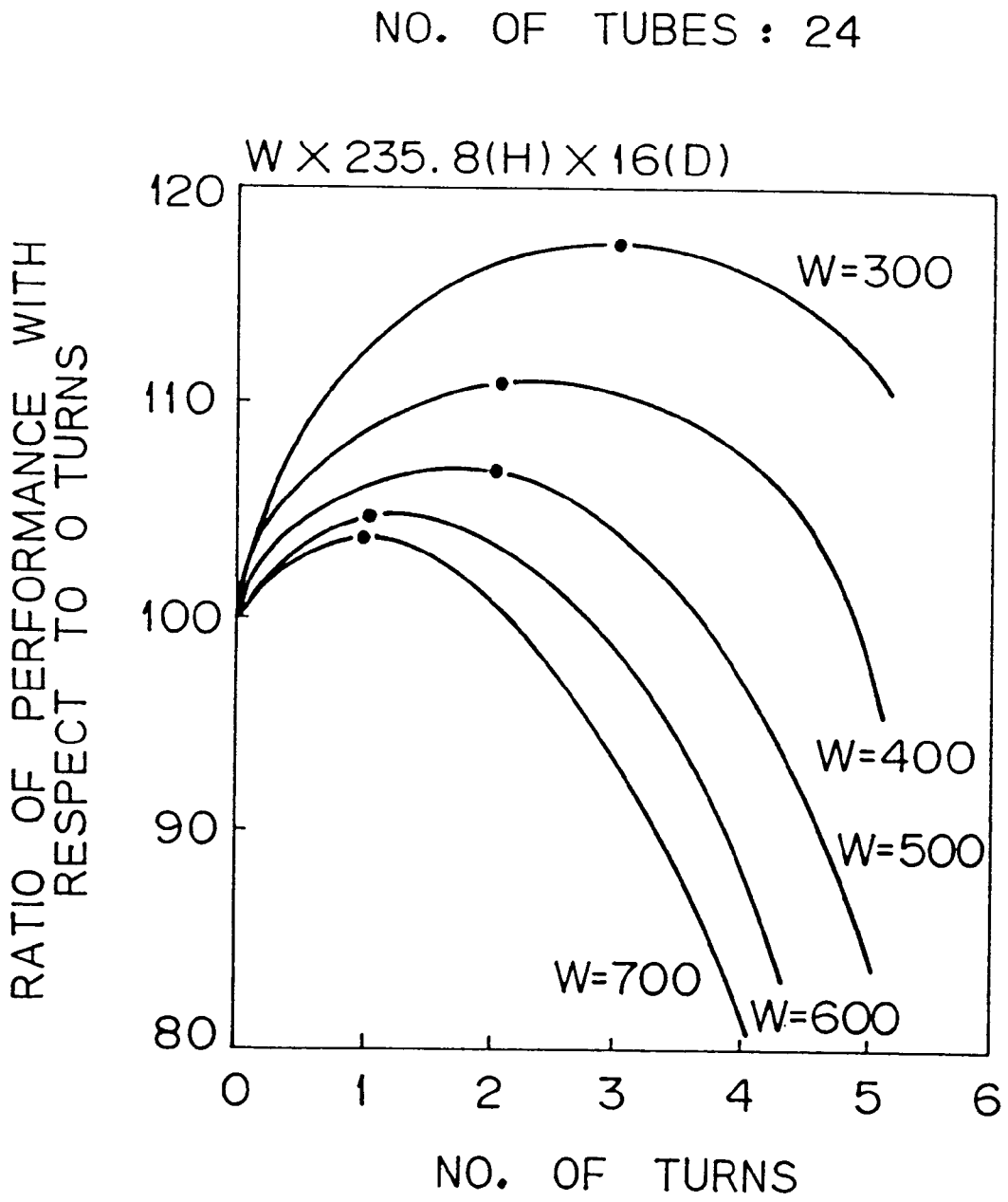
FIG. 4 is a graph of the relationship between the number of turns of the refrigerant passage and the ratio of performance with respect to 0 turns.
Figure 5:
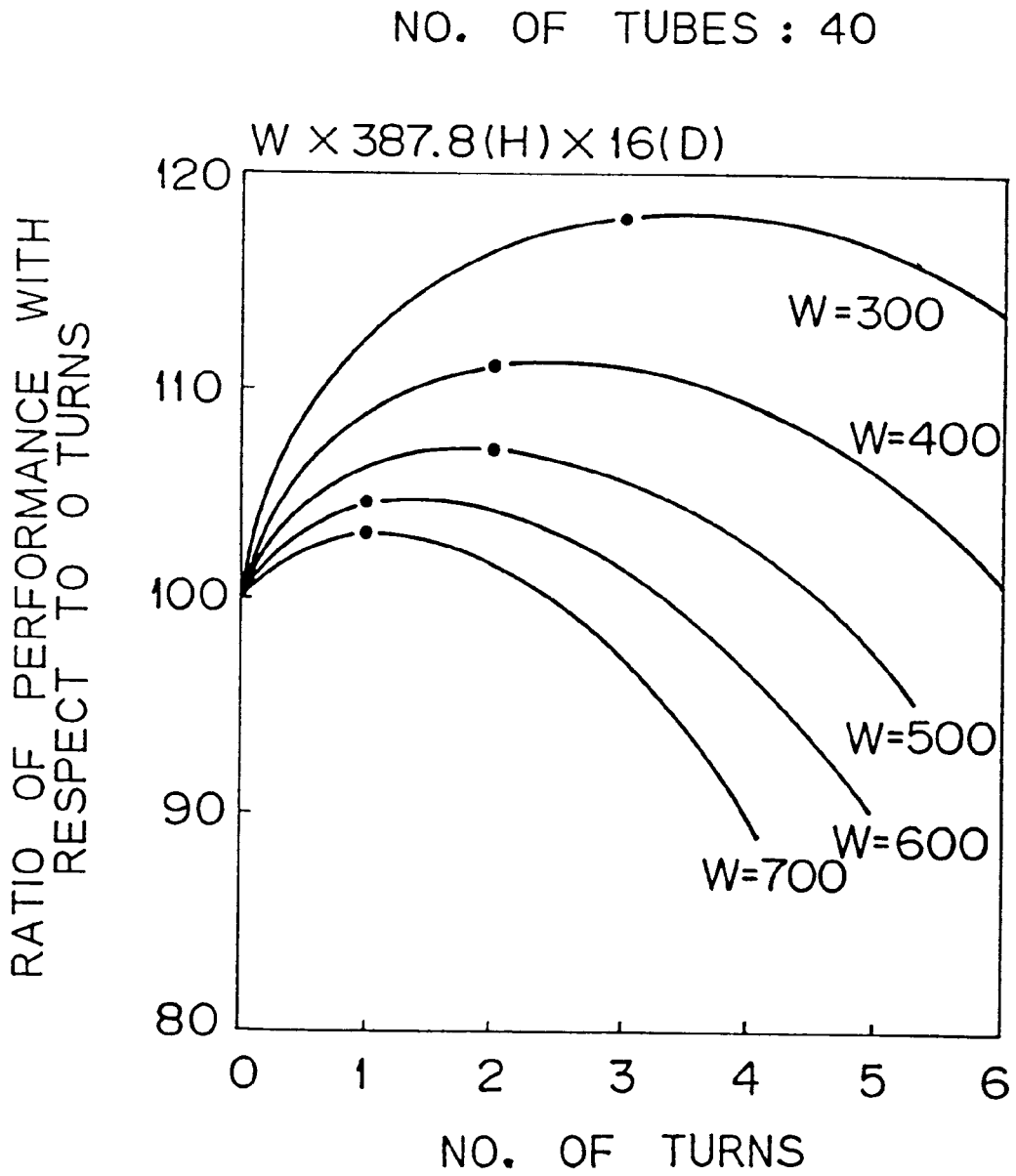
FIG. 5 is another graph of the relationship between the number of turns of the refrigerant passage and the ratio of performance with respect to 0 turns.
Figure 6A:
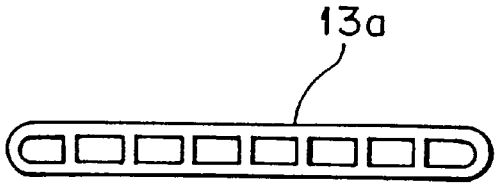
FIGS. 6A and 6B are sectional views of the core tubes.
Figure 6B:
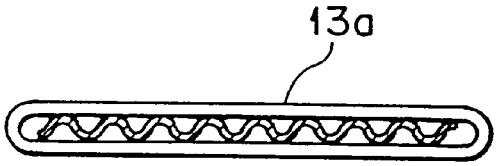

FIG. 4 and FIG. 5 show the trend in the number of turns of the refrigerant passage when the core size is set to various dimensions in the case of an equivalent hydraulic diameter de of the inside of the tubes 13*a* of 0.67 mm. That is, FIG. 4 shows the ratio of performance with respect to 0 turns when setting the core width W to from 300 mm to 700 mm in 100 mm increments and setting the number of turns of the refrigerant passage from 1 to 5 in a heat exchanger with 24 tubes 13*a*, a core height H of 235.8 mm, and a core thickness D of 16 mm (FIG. 2). FIG. 5 shows the ratio of performance with respect to 0 turns when setting the core width W to from 300 mm to 700 mm in 100 mm increments and setting the number of turns of the refrigerant passage from 1 to 6 in a heat exchanger with 40 tubes 13*a*, a core height H of 387.8 mm, and a core thickness D of 16 mm. The dots on the curves in FIG. 4 and FIG. 5 show the optimal performance points of each. The "equivalent diameter de" indicates the hydraulic diameter corresponding to the total sectional area of combined bores of a single tube 13*a*, since the shape of the tubes 13*a* is at a section of the tube 13*a*, usually the sectional shapes shown in FIGS. 6A and 6B. That is, it is defined as de (equivalent diameter)=4×(total hydraulic sectional area)/(total wet edge length).

Here, various combinations of numbers of tube 13*a* are considered for various numbers of turns, but FIG. 4 and FIG. 5 show the ones with the optimal performance obtained as a result of calculation. That is, the performance of a condenser is determined by the balance of the improvement of the heat exchange rate and the pressure loss. The two have effects on each other, so it is possible to derive this by converting the relationship between the two to a numerical equation. Using this, it becomes possible to find the efficiencies of various heat exchangers. Further, for this calculation, detailed heat transmission rate characteristics and pressure loss characteristics were found by experiment and the results were used to prepare a simulation program and perform analysis. For the settings of the parameters at this time, the heaviest load conditions in the refrigeration cycle of a car air-conditioner were envisioned and use was made of an air temperature at the condenser inlet of 35° C., a condenser inlet pressure of 1.74 MPa, a superheating of the condenser inlet of 20° C., a subcooling of the condenser outlet of 0° C., an air flow of the condenser inlet of 2 m/s, and a refrigerant of HFC-134a. The analysis and the experimental findings were compared. As a result, the present inventor confirmed that the results of analysis and the experimental values substantially matched in the range of an equivalent diameter of the tubes 13*a* of 0.6 mm to 1.15 mm. Further, the inventor confirmed that the number of turns giving the optimal performance shown in FIG. 4 and FIG. 5 (optimal number of turns) is substantially the same even if the pitch of the fins differs or the core thickness D differs.

From FIG. 4 and FIG. 5, it is learned that so long as the core width W is the same, the optimal number of turns is the same even if the number of tubes 13*a* differs. This means if the core width is the same, the optimal number of turns is the same regardless of the combination of the numbers of tubes 13*a*.

Figure 7:
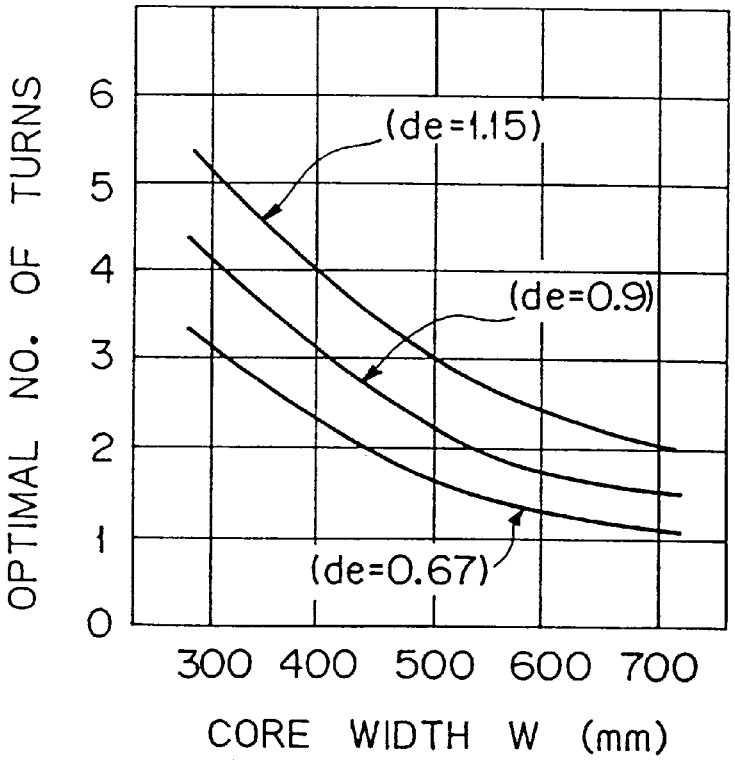
FIG. 7 is a graph of the relationship between the core width and the optimal number of turns.
Figure 8:
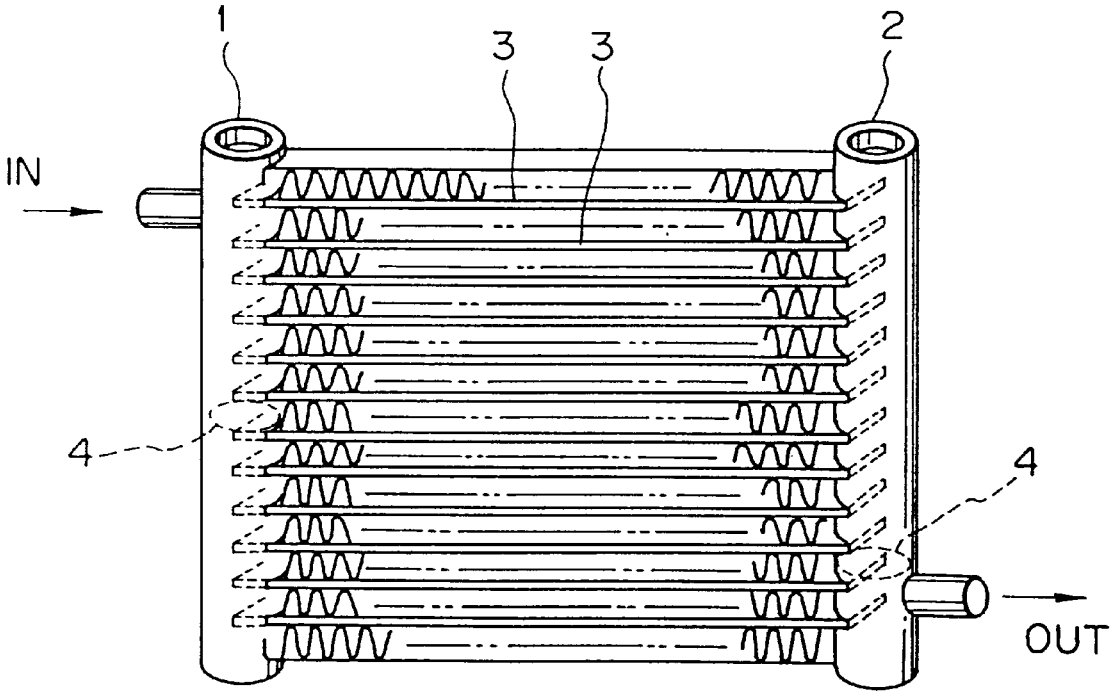
Fig. 8 PRIOR ART
FIG. 8 is a schematic view of the construction of a heat exchanger in the related art.

FIG. 7 shows the results of the above calculation for tubes 13*a* of different equivalent diameters de to find the optimal number of turns for different core widths W. In this case, while there are only whole numbers of turns in actuality, regions other than those of integers are also shown so as to illustrate the trends.

Now then, in FIG. 7, looking at the tubes 13*a* with a de of 0.67 mm for example, the condensation distance L at the optimal number of turns is 3 when W=300 mm, so L=(3 (turns)+1)×300=1200 mm. When W=400 mm, it becomes 2 turns, so L=(2+1)×400=1200 mm. When W=500 mm, it becomes 2 turns, so L=(2+1)×500=1500 mm. When W=600 mm, it becomes 1 turn, so L=(1+1)×600=1200 mm. When W=700 mm, it becomes 1 turn, so L=(1+1)×700=1400 mm. Further, when the equivalent diameter de of the tubes 13*a* is 0.9 mm, the condensation distance L becomes 1500 mm when W=300 mm, 1600 mm when W=400 mm, 1500 mm when W=500 mm, 1800 mm when W=600 mm, and 1400 mm when W=700 mm. Further, when the equivalent diameter of the tubes 13*a* is 1.15 mm, the condensation distance L becomes 1800 when W=300 mm, 2000 mm when W=400 mm, 2000 mm when W=500 mm, 1800 mm when W=600 mm, and 2100 mm when W=700 mm. Usually, the core width W of a refrigerant condenser used for a car air-conditioner is about 300 mm to 800 mm, so from the results of the above calculations, it is learned that when the equivalent diameters de of the tubes 13*a* are the same, there is not that much effect on the core width W and the optimal condensation distance L lies in a certain range.

Therefore, it is possible to specify the optimal condensation distance L for an equivalent diameter de of tubes 13*a*. FIG. 1 shows the results when changing the equivalent diameters de and finding by the above analysis the range of the optimal condensation distances L for those de. Linear approximation of the data obtained enables the optimal condensation distance L to be set as $$L=400+1180\,de \text{ to } 700+1180\,de \tag{1}$$

where the units of L and de are also millimeters.

Therefore, if the equivalent diameter de of the tubes 13*a* of the core 13 of the heat exchanger is known, it is possible to find the optimal condensation distance L from equation (1), so it becomes possible to set the optimal number of turns (N) by finding the number of turns matching that condensation distance from the following equation (2):

$$\text{N (number of turns)}=L/W-1 \tag{2}$$

Further, since the number of turns must be an integer, it is necessary to round off the number of turns found from equation (2).

Figure 9:
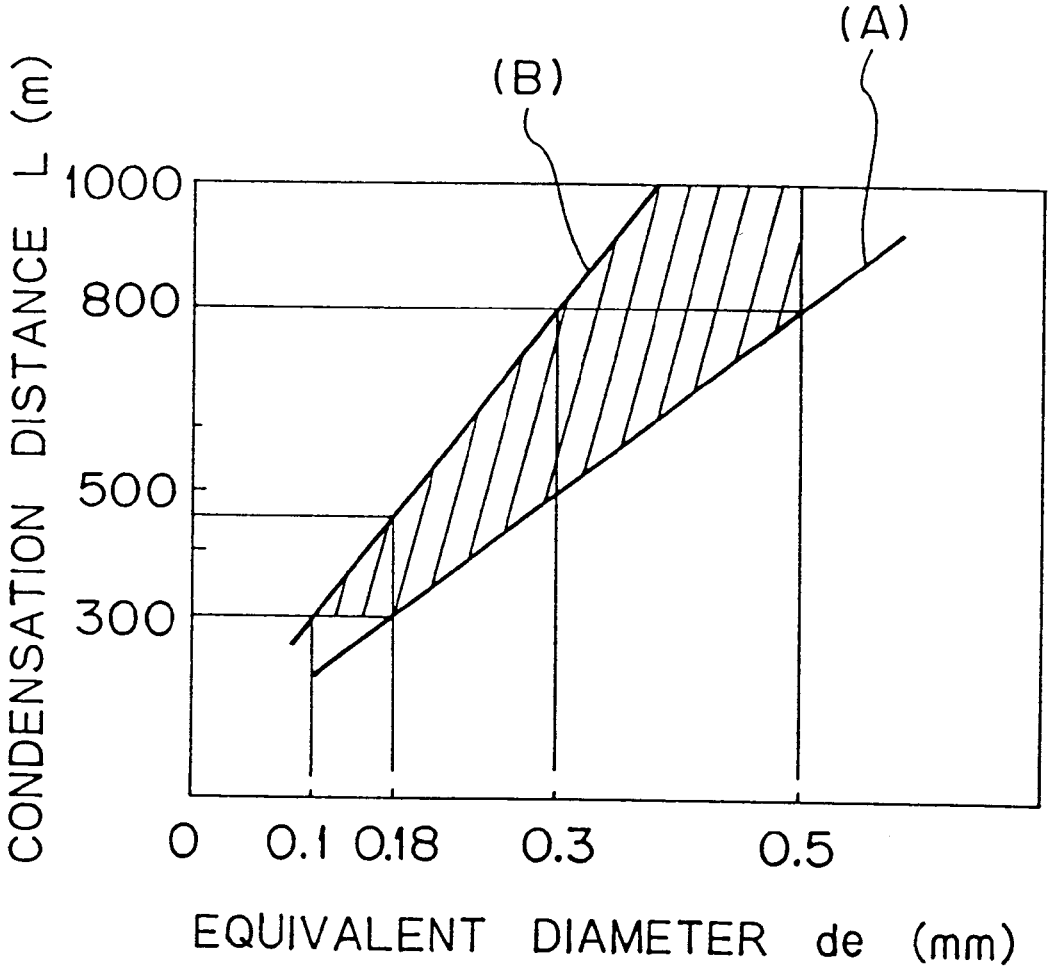
FIG. 9 is a view of the relationship between the equivalent diameter of tubes and the condensation distance in tubes with a small equivalent diameter.

In recent years, advances in the manufacturing technology for tubes of refrigerant condensers have made possible the production of tubes with extremely small equivalent diameters. If the above equation (1) is applied to such very small tubes, the number of turns is set to 0. For example, FIG. 9 shows the results obtained by using the above-mentioned simulation program to find the optimal condensation distance at an idle high load (A) and a 40 km/h constant load (B) for tubes with an equivalent diameter de of less than 0.60 mm. Looking at just the line of the idle high load (A), when the equivalent diameter is 0.18 mm to 0.5 mm, the optimal condensation distance L becomes 300 to 800 mm, so as mentioned above, 0 number of turns is the optimal specification when the core width W is 300 mm to 800 mm.

In this way, by making the tubes ones with an equivalent diameter of 0.18 mm to 0.5 mm, it is possible to provide a refrigerant condenser with a good efficiency with 0 number of turns. A condenser with 0 number of turns does not require any separators for dividing the headers, so the work of inserting the separators and the process of detecting leakage of refrigerant from the separator portions become unnecessary. Further, it becomes possible to simplify and standardize the shape of the header portions. Further, compared with the case of use of tubes with a large equivalent diameter as shown in FIG. 9, the fluctuation in the optimal condensation distance due to load fluctuations becomes smaller, so it is possible to maintain the optimal state for the load conditions even if the load conditions fluctuate.

As explained above, in the present invention, the optimal condensation distance L is determined from the equivalent diameter de of the tubes 13*a* of the core 13 of the heat exchanger and the optimal number of turns of the refrigerant passage is found from the condensation distance L, so the present invention differs from the related art, which only suggested that an increase of the number of turns or a decrease of the sectional area of the passage contributed to an improvement of the heat exchange rate and therefore it is possible to design a heat exchanger with a high heat exchange rate.

We claim:

1. A refrigerant condenser comprising:

a plurality of superposed tubes having opposing ends, a pair of headers joined to the tubes at the ends thereof, and separators disposed inside the headers for dividing the tubes into a plurality of groups, a high temperature, high pressure gaseous refrigerant flowing through the tube groups changing in direction of flow in the headers, when the number of times the direction of flow is changed in the headers is N and the distance between the pair of headers is W (unit: mm), the distance W being selected within the range of 300 to 800 mm, the condensation distance L (unit: mm) of the refrigerant is expressed by the equation: $L=(N+1)W$, and the condensation distance L (unit: mm) is $L=400+1180$ de to $700+1180$ de where the equivalent diameter in the tubes corresponding to the tube area is de (unit: mm), and the equivalent diameter de (unit: mm) of the tubes is less than 1.15 mm, the number N being an integer rounded from the expression $(L/W)-1$.

2. A refrigerant condenser according to claim 1, wherein the equivalent diameter de (unit: mm) of the tubes is made greater than 0.60 and less than 1.15.

* * * * *